United States Patent [19]

Frederick

[11] Patent Number: 4,528,887

[45] Date of Patent: Jul. 16, 1985

[54] TUNING DEVICE FOR STRING INSTRUMENTS

[76] Inventor: J. Robert Frederick, 3600 Schenley Ave., Ashtabula, Ohio 44004

[21] Appl. No.: 520,432

[22] Filed: Aug. 4, 1983

[51] Int. Cl.[3] ..... G10D 3/14

[52] U.S. Cl. ..... 84/306; 84/312 R

[58] Field of Search ..... 84/200, 202, 306, 297 R, 84/312 R, 454, 455

[56] References Cited

U.S. PATENT DOCUMENTS

| | | | |
|---|---|---|---|
| 361,500 | 4/1887 | Gardner | 84/306 |
| 2,955,503 | 10/1960 | Braverman | 84/306 |
| 4,098,163 | 7/1978 | Kato | 84/306 |
| 4,191,086 | 3/1980 | Spercel | 84/306 |

*Primary Examiner*—Benjamin R. Fuller

*Attorney, Agent, or Firm*—Francis T. Kremblas, Jr.

[57] ABSTRACT

An improved tuning device for mounting upon stringed musical instruments such as the guitar, banjo, mandolin and the like. The improvement relates to providing a construction wherein the winding spindle or drum upon which the string is attached may be selectively and independently rotated on a one to one basis or on a high multiple to one basis. The one to one turning ratio is designed to be used to initially wind the string from a relaxed condition to a pre-tuned degree of tension associated with replacing worn or broken strings. The multiple tuning basis is, in typical fashion, employed to fine tune the string tension to produce the appropriate musical note.

4 Claims, 18 Drawing Figures

TUNING DEVICE FOR STRING INSTRUMENTS

BACKGROUND

Musical string instruments, such as the guitar, banjo, or mandolin and the like are provided with a string tuning device for each string mounted on the head of the instrument. This device, commonly referred to as a tuning key, is used to vary the tension of the string drawn over the fretted elongate neck portion of such instruments.

The common practice involves providing a winding spindle or drum for each string. The spindle is mounted on the head of the instrument and the string is wound several times around the winding spindle.

This procedure first provides a binding attachment of the string to the spindle or drum and, secondly, stresses the string tensionally along the neck to provide upon vibration, an appropriate musical tone. The rotation of the spindle or winding drum is typically manipulated by means of a tuning key which affords the musician a means to tune the string by increasing or decreasing the string tension.

Typically, this rotation of the string winding spindle is accomplished by use of a worm-gear engaged by a worm. The worm-gear is arranged in a position axially common with the winding spindle and is typically fixed to it at some distance from the string windings. The connecting shaft between the spindle and worm-gear is supported by a bearing arrangement to permit rotation. Usually some form of thrust bearings are employed to maintain the proper operating position of the worm-gear in relation to the worm. Ordinarily the worm and the associated shaft is mounted in a bearing structure and provided with means to prevent its longitudinal displacement while permitting free rotation. The outer extremity is provided with a handle means, commonly referred to as the tuning key, to facilitate the manual turning of the worm shaft and hence the worm-gear to provide rotation of the winding spindle. In instruments of high quality there is usually a rotation-retarding brake on the worm-shaft. It is commonly understood that the engagement of a worm with a worm-gear provides a locking of the rotation of the gear. Under certain circumstances such as vibrations of frequencies in the audible range, rotational force on the gear may be transmitted to the worm, causing its rotation and allowing the instrument to become un-tuned while being played. An increased friction applied to the worm or its shaft, usually a spring loaded device, minimizes or prevents this undesirable reaction.

However, in prior art constructions, replacement of broken string, requires an inordinate amount of effort and time to accomplish several turns of the new replacement string onto the winding spindle. In many instances, three or four complete revolutions of the string around the winding spindle is required to achieve a pre-tuned degree of tension in the string beginning with the initially relaxed condition of the new string attached to the spindle.

Since most worm to worm-gear ratios in instruments of this kind are of a high magnitude, such as fifteen to one for example, each turn of the winding spindle requires approximately thirty typical wrist-finger motions applied to the turning key to rotate the worm shaft. Therefore to accomplish three or four winding spindle revolutions, ninety to one hundred and twenty finger-wrist motions are required.

If six strings are replaced, several hundred time-consuming finger-wrist rotations are required merely to re-string the instrument. The present invention preserves the advantages of the prior art constructions, however, it offers a convenient means to directly turn the winding spindle in a one to one ratio and eliminate the menial, often aggravating requirement of an undue multiplicity of finger-wrist motions to attach the strings to the instrument and to merely obtain the pre-tuned degree of string tension necessary prior to fine tuning of each string.

SUMMARY OF INVENTION

The present invention relates generally to tuning devices for musical string instruments and particularly to a tuning device which drammatically improves the facility to replace worn or broken strings without interfering with the ability to fine tune the string tension to obtain the desired musical tone.

In accordance with the present invention, the tuning device is constructed to permit one to rotate the winding spindle manually on a one to one basis independent of the high multiple ratio of the worm and worm-gear used to fine tune the instrument.

In one embodiment of the present invention, the worm-gear is integrally and concentrically connected to the shaft of the winding spindle and to a winding knob by which the winding spindle may be rotated. The worm, which engages the worm-gear, is mounted for longitudinal displacement against a bias spring force. This permits one to manually rotate the winding spindle which causes the worm-gear to become operatively disengaged from the normal engagement with the worm wherein the worm and worm-gear function similar to a ratchet and pawl assembly when the winding spindle shaft is manually rotated by turning the winding knob.

In another embodiment of the present invention, the shaft of the winding spindle is releasably connected to the worm-gear by means of a key and key-way construction and may be longitudinally displaced upon releasing the keyed connection with the worm-gear to permit direct rotation of the winding spindle independent of the engagement between the worm and worm-gear.

In yet another embodiment, independent rotation of the shaft carrying the winding spindle is accomplished by means of a ratchet and pawl construction provided on the worm-gear and a knob-like portion of the shaft carrying the winding spindle. Then the knob may be manually rotated in one direction to effectively wind a replacement string to a pre-tuned degree of tension. Once this tension is established, the fine tuning of the string may be accomplished by manipulation of the shaft carrying the worm to cause rotation of the worm-gear in either direction.

OBJECTS

It is a primary object of the present invention to provide a tuning device for musical string instruments which can be selectively manipulated to rapidly rotate the winding spindle to facilitate the replacement of worn or broken strings while maintaining the ability to finely tune the string in a generally conventional manner.

It is another object of the present invention to provide a tuning device of the type described in which the common and conventional means for finely adjusting the string tension are basically preserved and operate without interference from the means providing direct and more rapid rotation of the winding spindle.

It is another object of the present invention to provide a tuning device of the type described wherein the component parts for the direct drive one to one turning ratio and the high ratio worm and worm-gear drive for rotating the winding spindle are mounted in a compact manner in a housing having a substantially similar appearance to a conventional tuning device.

It is a further object of the present invention to provide in one of its embodiments, all of the desirable features described above, in addition to facilitating easier removal of a broken string from the winding spindle.

IN THE DRAWINGS

DETAILED DESCRIPTION

Figure 1:
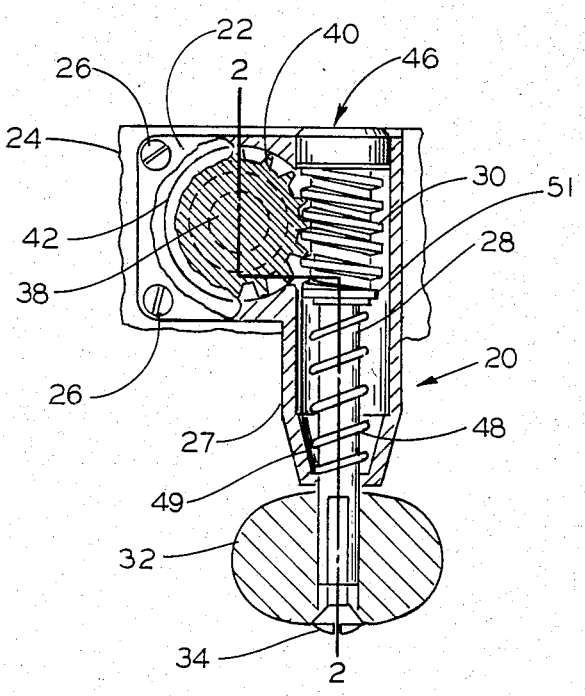
FIG. 1 is a front elevational view in section of a tuning device constructed in accordance with the present invention, the section being taken along the centerline of each portion of the housing.
Figure 3:
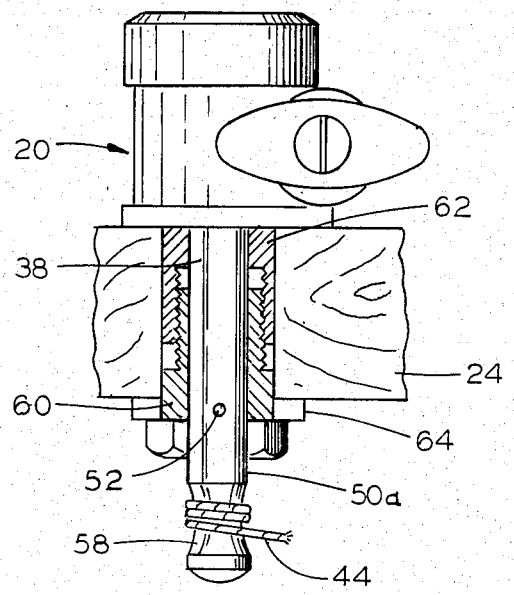
FIG. 3 is a bottom plan view partially in section of the device shown in FIG. 1 iilustrating an integrally provided outer bearing means for the winding spindle.
Figure 2:
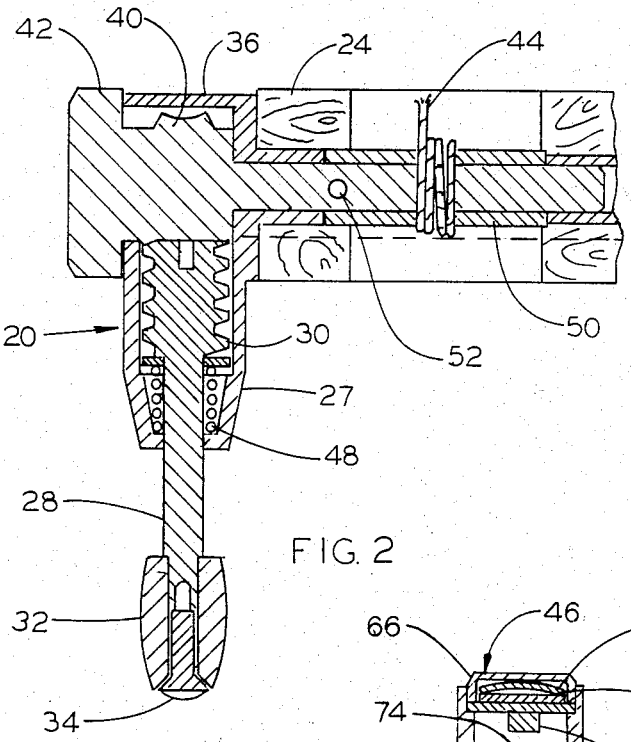
FIG. 2 is a right side elevational view in section of the device shown in FIG. 1 illustrating the slideable displacement of the shaft carrying the worm, the section being taken along line 2—2 in FIG. 1 and illustrating a modification for providing an outer bearing surface for the winding spindle.

An improved tuning device for musical string instruments constructed in accordance with the present invention is shown in FIGS. 1–3. Such devices are typically attached to the head portion of the instrument, one for each string. After fixing one end of the string in a conventional manner at a point on the base of the instrument, the string is aligned along the fretted neck portion and is attached to the winding spindle of a given tuning device. The attachment to the winding spindle is usually accomplished by a criss-cross binding of the string as it is wound about the winding spindle three or four times. This process also establishes a pre-tuned degree of tension in the string which must then be finely adjusted by the user in order to produce the appropriate musical sound upon vibration of the string.

Since the device of the present invention may be attached to the heads of such instruments in any conventional manner, the illustrations and descriptions herein do not deal in detail with the instrument as a whole.

Referring to FIGS. 1 and 2, the improved tuning device of the present invention includes a housing, indicated generally at 20, which may include a plate 22 secured to the head portion of the instrument 24 by screws 26.

In a conventional manner, the housing includes one cylindrical portion 27 to provide a bearing for a shaft 28 provided with a worm 30. The outer extension of shaft 28 is provided with a handle or key 32 fixed to the shaft by a screw 34.

Housing means 20 also includes integrally formed cylindrical portion 36 which provides a bearing member for the shaft 38 which is fixed to or otherwise integrally formed with worm-gear 40. The outer extension of shaft 38 may be provided with a knob or handle 42 fixed to or integrally formed with shaft 38. Alternatively, the end of shaft 38 may be provided with a screwdriver or coin slot, not shown, to facilitate manual rotation.

Figure 4:
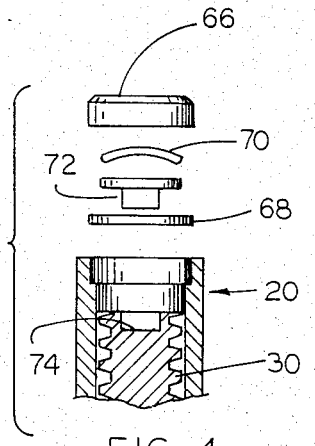
FIG. 4 is a partial front elevational view of a portion of the device shown in FIG. 1 shown in exploded relationship illustrating a braking means which may be used in connection with the present invention.
Figure 5:
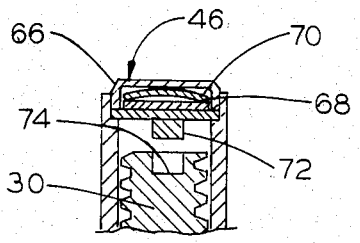
FIG. 5 is a view of that portion of the apparatus shown in FIG. 4 with the component parts assembled and disposed at a 90 degree angle relative to FIG. 4.
Figure 6:
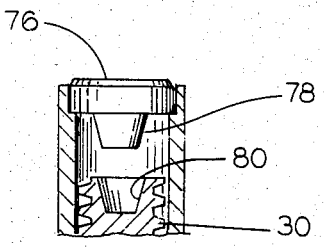
FIG. 6 is a view similar to the view shown in FIG. 5 illustrating a modified braking means.

As shown in FIGS. 1 and 2, the worm-gear 40 rotates integrally with shaft 38 and knob 42, and is engaged with and positioned in counter-clockwise rotation by the worm 30. The tension of a tuned string, such as 44, tends to force the wormshaft 28 toward a brake stop assembly, indicated generally at 46, which is fixed into housing 20 by means of a press fit or in any other suitable conventional manner. The detail of the construction of brake-stop assembly 46 is shown in FIGS. 4, 5 and 6 and will be described in detail later herein.

When, knob 42 is manually rotated in a clockwise direction, as shown in FIG. 1, the worm 30 and its associated shaft 28 is caused to move axially out of operative engagement with worm-gear 40. However, a spring 48 is disposed in surrounding relationship to shaft 28 between an annular shoulder 49 provided in housing 20 and a washer 51 which is disposed against the lower end of the worm to bias the worm 30 and shaft 28 into operative alignment with worm-gear 40.

Therefore, when knob 42 is rotated in a direction to wind on a loose or relaxed string, the worm 30 and shaft 28 function as a pawl with worm-gear 40 acting as a ratchet. This permits a user to manually rotate the winding spindle fixed to shaft 38 directly on a one to one basis independent of the ratio between the operative engagement between the worm 30 and worm-gear 40. FIG. 2 illustrates the axial movement of shaft 28 and worm 30 downwardly compressing spring 48 to a degree wherein the worm 30 and worm-gear 40 function as a pawl and ratchet as described above. Also, the user can manually pull key 32 and hence shaft 28 and worm 30 downward, further compressing spring 48, which allows free rotation of knob 42, worm-gear 40, shaft 38, and winding spindle 50 so that a remnant of a broken string may be conveniently removed by simply pulling on the loose end of the string 44.

As shown in FIG. 2, winding spindle 50 comprises a hollow cylinder which is fitted over shaft 38 and may be axially and rotationally fixed to shaft 38 by a pin 52. A common construction for providing bearing support for winding spindle 50 is shown in FIG. 2 while an alternative open-ended arrangement is shown in FIG. 3. Either form can be effectively used without departing from the spirit of the present invention.

In FIG. 2, spindle 50 fixed to shaft 38 is supported on an outer end by a bearing 54 fixed within a suitable aligned bore provided in the instrument head 24.

Specifically referring to FIG. 3, the open-ended winding spindle 50*a*, is partially hollow and mounted in surrounding relationship to shaft 38 and is fixed thereto by a pin 52. In this construction, the outer end of winding spindle 50*a* is provided with a narrowed neck portion 58, usually provided with a hole in which the loose end of a string may be inserted. The string is then wound around the neck portion 58.

The tuning device may be secured to the instrument head as shown in FIG. 3 by means of a threaded bearing nut 60 which is threaded to threads conventionally provided in a cylindrical extension 62 of housing 20. A protective washer 64 is typically provided between the head of nut 60 and the instrument head 24. Bearing nut 60 then provides a suitable outer bearing for winding spindle 50*a* and no other out-board bearing means is required.

Now specifically referring to FIGS. 4–6, a brake-stop assembly 46 is illustrated which can be employed in conjunction with the present invention to minimize or prevent detuning of the strings under the influence of audio frequency vibrations.

Assembly 46 comprises a cap 66 which is press fit or otherwise fixed into a recess provided in housing 20 and is forced against a washer 68 to create a cavity in which a spring disc 70 and a keyed brake disc 72 are disposed.

The end of worm 30 is provided with a key-way 74. When keyway 74 is engaged by the key of brake disc 72, undesired rotation of worm-shaft 28 is retarded.

An alternative braking means is illustrated in FIG. 6 wherein a cap 76 is provided with a braking cone 78 which is adapted to be frictionally received in a conical recess 80 provided in the end of worm 30.

When the worm is forced onto the braking cone with increasing force, the rotary action of the worm will be frictionally retarded. This tends to retard the detuning of the strings for the reasons discussed above.

Now referring to FIGS. 7–12, another embodiment of a tuning device constructed in accordance with the present invention is illustrated. Those components of this embodiment which are essentially identical will be described using the same reference numerals as used to described the embodiment shown in FIGS. 1–3. Those components or parts thereof which are similar but modified will be identified by the same reference numeral as previously used followed by the letter "b" where it is appropriate.

Figure 7:
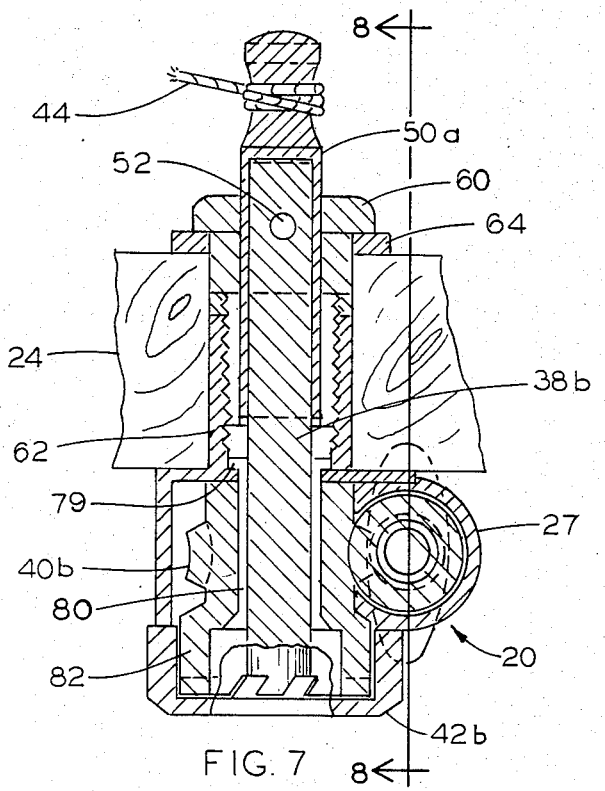
FIG. 7 is a front elevational view in section of another embodiment of a tuning device constructed in accordance with the present invention.
Figure 8:
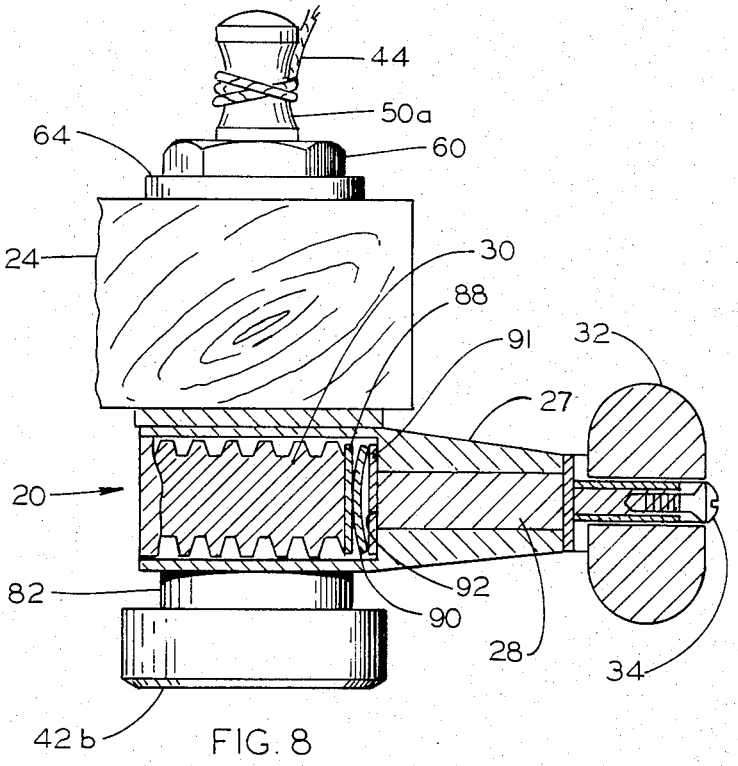
FIG. 8 is a side elevational view partially in section of the embodiment shown in FIG. 7, the section being taken along line 8—8 in FIG. 7 and which illustrated the displacement of the winding spindle shaft from the worm-gear.

Specifically referring to FIGS. 7 and 8, the embodiment includes a conventionally shaped winding spindle 50*a* which includes a hollow portion mounted over a portion of shaft 38*b* and is axially and rotationally fixed to shaft 38*b* by a pin 52. Winding shaft 38*b* passes through hollow screw or support bearing 60 which is threaded into a threaded cylindrical extension 62 of the housing, indicated generally at 20. This arrangement includes a protective washer 64 and serves to clamp the entire tuning device unit in a cylindrical bore conventionally provided in the instrument head 24.

Shaft 38*b* also passes through an axial bore in worm-gear 40*b* and is free to move axially a distance determined by the position of the winding spindle 50*a* as it is caused to stop, in one direction, as it contacts a shoulder 79 of retaining sleeve 80 which is co-axially integral with the bore in worm-gear 40*b*. In the opposing direction, axial movement of shaft 38*b* is limited by the engagement between knob 42*b* and a keyed rim on a hub extension 82 provided on worm-gear 40*b*.

Turning knob 42*b* is integrally formed or otherwise fixed to winding shaft 38*b*.

Housing 20, in a similar manner as previously described in connection with the embodiment of FIGS. 1–3, includes a cylindrical cavity in housing extension 27 that surrounds and provides a bearing for a worm 30 and its integral shaft 28 and also positions the worm and shaft in operative engagement with worm-gear 40*b*. Turning the worm 30 and shaft 28 by manual manipulation causes the worm-gear 40*b* to rotate, and when worm-gear 40*b* is connected with the shaft 38*b*, causes the fixed assembly of shaft 38*b*, knob 42*b* and winding spindle 50*a* to rotate in one direction or the other to fine tune the instrument. A handle or key 32 is conventionally fixed to the outer end of shaft 28 by a threaded fastener 34 to facilitate the fine tuning process accomplished by rotation of worm shaft 38. The ratio of rotation between the worm shaft 38 and the winding spindle 50*a* is determined by the worm and worm-gear ratio which typically is chosen to be in the range of about fifteen to one.

Figure 9:
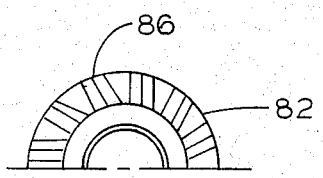
FIG. 9 is a partial plan view of the device of FIG. 7 illustrating the key-ways provided on a flanged extension of the worm-gear.
Figure 10:
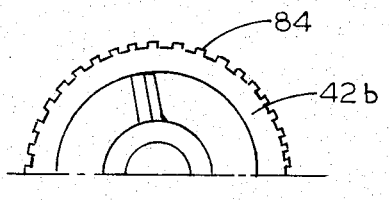
FIG. 10 is a partial plan view of the device of FIG. 7 illustrating a plurality of keys provided on the knob portion of the winding spindle shaft which mate with the key-ways shown in FIG. 9.
Figure 11:
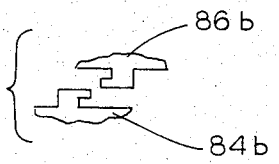
FIGS. 11 and 12 are front elevational views of alternative shapes for keying the engagement between the worm-gear and the knob portion of the winding spindle.

With continued reference to FIGS. 7 and 8, winding shaft 38*b* is releasably connected to worm-gear 40*b* by means of a plurality of keys 84, provided on the inner surface of knob 42*b*, which are adapted to mate with a plurality of keyways 86 provided on face of hub 82, as best seen in FIGS. 9 and 10.

When the knob 42*b* and associated shaft 38*b* and winding spindle 50*a* are pulled downwardly as illustrated in FIG. 8, the engagement between keys 86 and 84 is released to permit manual rotation of this assembly free of any relationship with worm-gear 40*b*. In this withdrawn position, one may directly cause rotation of winding spindle 50*a* in a one to one ratio to wind string 44 around spindle 50*a* the necessary number of turns to achieve attachment and a state of pre-tuned tension.

At this point, knob 42*b* is manually forced toward its original position to manipulate the engagement between the keys 84 and keyways 86. The tension of the string in its pre-tuned state applies a stress force upon the winding spindle 50*a* which tends to rotate the knob 42*b* in a direction which tends to secure the engagement between keys 84 and keyways 86.

Upon achieving the pre-tuned degree of tension as described, and re-establishing the keyed connection between knob 42*b* and hub 82 integrally fixed to worm-gear 40*b*, the user may now manually turn tuning key 32 to fine tune the string 44 in the conventional manner utilizing the high turn ratio determined by the operative engagement of the worm 30 and worm-gear 40*b*.

As seen in FIG. 8, a washer 88 surrounds shaft 28 and engages the right end of worm 30. A spring washer 90, which is stressed in aseembly is disposed between washer 88 and a bearing washer 91 which abuts a shoulder 92 provided in housing 20. Spring washer 90 is stressed in assembly and the shaft 28 is axially fixed in the operating position with the worm-gear upon tightening threaded fastener 34.

This arrangement functions to retard the free turning of the worm and thus minimize or prevent inadvertent de-tuning of the tuned string which induced by audio vibrations produced during use of the instrument.

Figure 12:
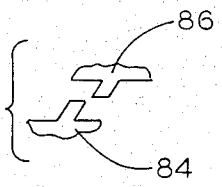

FIG. 12 illustrates one alternative shaping of the keyed relationship between hub 82 and knob 42*b*. The key 84*b* is adapted to mate with keys 86*b* to prevent displacement of the keys by force applied to the winding spindle 50*a*. However, it should be understood that other means may be usefully employed to obtain a releasable keyed relationship between the worm-gear 40*b* and the winding shaft 38*b* without departing from the spirit of the present invention.

Another embodiment of a tuning device constructed in accordance with the present invention is illustrated in FIGS. 13–18. Similar reference numerals will be used to describe identical or substantially identical components as previously used with reference to the embodiments shown in FIGS. 1–12. Those relevant components which are modified in this embodiment will be identified by a small case letter "c" after the reference numeral.

Figure 13:
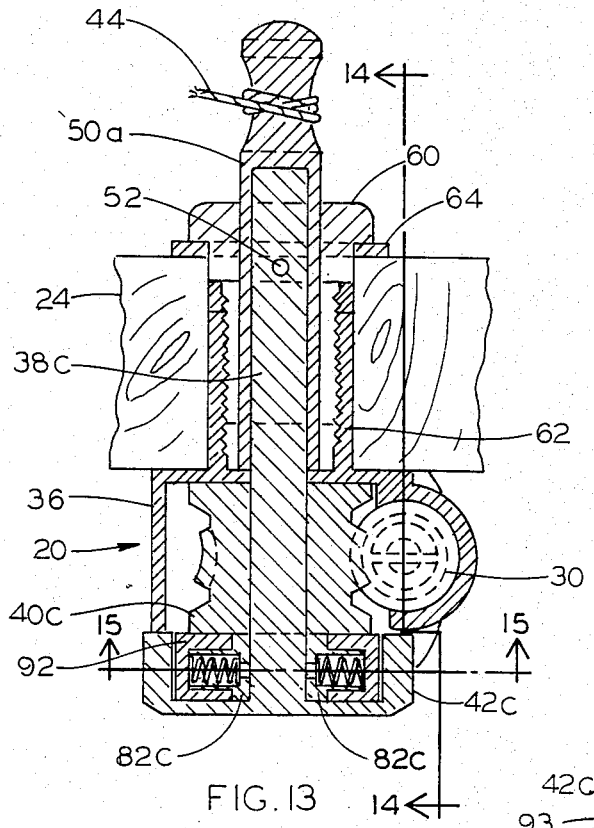
FIG. 13 is a front elevational view in section of another embodiment of a tuning device constructed in accordance with the present invention.
Figure 15:
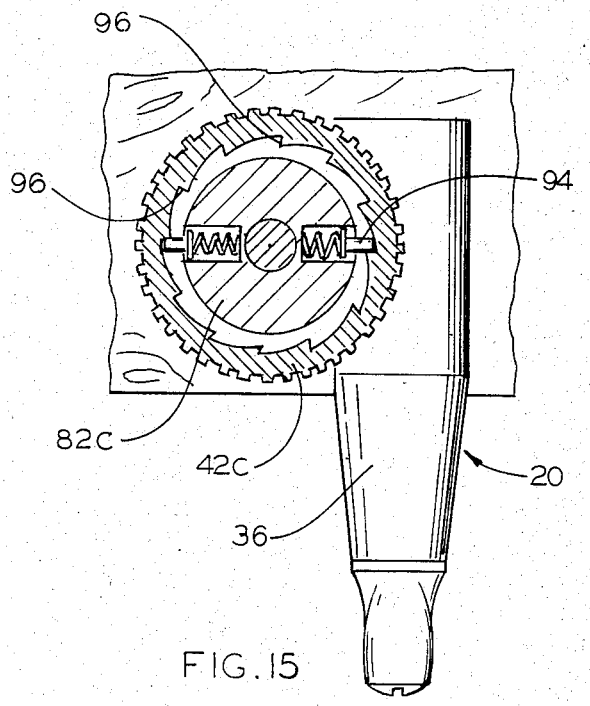
FIG. 15 is a bottom plan view of the embodiment of FIG. 13 in section, the section being taken along line 15—15 in FIG. 13.
Figure 16:
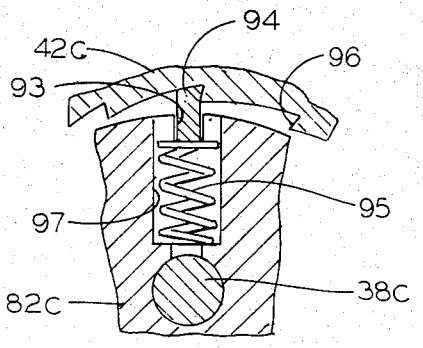
FIG. 16 is a partial view of a portion of the worm-gear and the knob-portion of the winding spindle as shown in FIG. 15 illustrating the ratchet and pawl construction.
Figure 14:
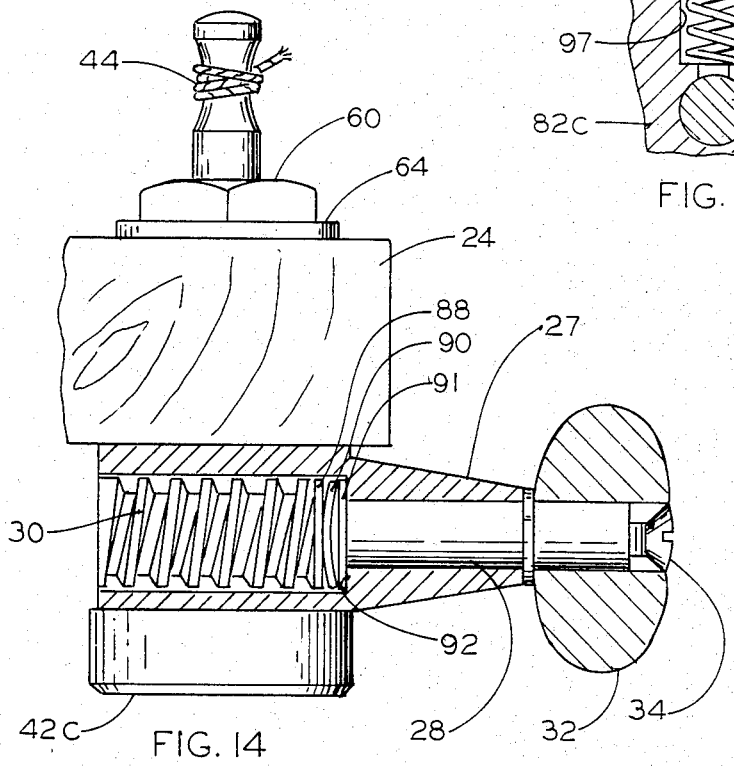
FIG. 14 is a side elevational view in section of the embodiment shown in FIG. 13, the section being taken along line 14—14 in FIG. 13.
Figure 17:
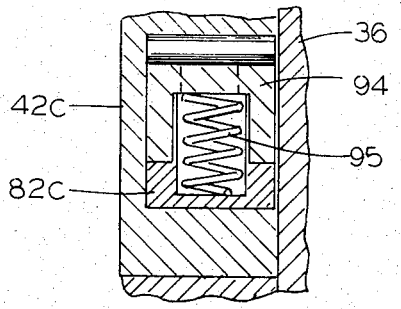
FIG. 17 is a side elevational view in section of the ratchet and pawl construction shown in FIG. 16.
Figure 18:
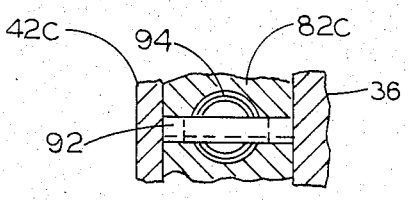
FIG. 18 is a top plan view of portion of the ratchet and pawl construction shown in FIG. 17.

Referring now to FIGS. 13, 14 and 15, a housing, indicated generally at 20, provides an enclosure and bearing for a winding spindle 50*a* which is axially and rotationally fixed to a winding shaft 38*c* in an identical manner as previously described via pin 52. A hollow bearing nut 60 is also identically mounted to a housing extension 62 to provide a bearing for winding spindle 50*a* and to bind the whole unit to the instrument head 24. A protective washer 64 is provided between the head of nut 60 and body 24.

The main body portion 36 of housing 20 provides an axial bearing for winding shaft 38*c*, a cavity surrounding worm-gear 40*c* and also includes a cylindrical cavity 27 which provides bearing and support for a worm 30 and integrally formed shaft 28 at the appropriate location to operatively engage worm 30 with worm-gear 40*c*.

Worm-gear 40*c* is supported rotationally free and concentric with shaft 38*c* and is provided with an integrally formed extension or hub 82*c* which is disposed into an annular cavity in a knob turning handle portion 42*c*. Knob 42*c* is generally annular in shape and is provided with knurling or the like on its outer surface to facilitate manual rotation thereof and is integral or otherwise fixed to shaft 38*c*, which in turn, is fixed to winding spindle 50*a* as previously described.

Hub 82*c* of worm-gear 40*c* is provided with a plurality of radially disposed slots 93 which are adapted to receive a pawl 94 disposed to freely slide toward the inner surface of knob 42*c*. A spring 95 is disposed in a counterbore 97 aligned with each slot 93 to bias the pawls 17 outwardly toward a plurality of ratchet serrations 96 provided on the inner surface of knob 42*c*.

When the pawls 94 are engaged with the ratchet serrations 96 under the bias force of springs 95, the knob 42*c* may be manually turned clockwise as shown in FIG. 15. The hub 82*c* and worm-gear 40*c* remain stationary as the pawls are forced to retract during the clockwise rotation of knob 42*c*. In this manner, it should be readily apparent that knob 42*c*, shaft 38*c* and spindle 50*a* may be rotated in a clockwise direction to wind a string around the neck portion of spindle 50*a* independently of the operative turning ratio between worm-gear 40*c* and worm 30. Once the string has been wound upon spindle 50*a* sufficiently to obtain a degree of pre-tuned tension, rotation of shaft 28 and worm 30 may be used to fine tune the string tension to produce the desired musical tone. Once the string 44 is under tension, rotation of key 32 and the associated shaft 28 and worm 30 in one direction or the other will operate to increase or decrease the string tension accordingly in a turning ratio established by the worm and worm-gear.

To provide for means to reduce or prevent undesirable turning of the worm and hence the worm-gear induced by audio vibrations during use of the musical instrument, an identical arrangement as described in the embodiment shown in FIGS. 7 and 8 may be employed.

The washers 88 and 91 and the spring washer 90 when stressed in assembly, tend to retard the free turning of worm 30. The key 32 is fixed to an upper portion of shaft 28 by threaded fastener 32 to complete the assembly.

From the foregoing description it should be readily appreciated that the present invention provides a very significant improvement in string instrument tuning devices. A user may quickly and easily replace worn or broken string with a very drammatic decrease in time and effort, yet fine tune each string in the conventional manner. Further, the construction of the device incorporating the advantages of the present invention does not interfere with the typical and accustomed manner of fine tuning the strings.

What is claimed is:

1. In a tuning device for musical string instruments, the combination of a housing means; a first shaft means rotatably mounted in a said housing and provided with a worm, one end of said first shaft means extending out of said housing and carrying a fixed handle-like key to facilitate manual rotation of said first shaft means, second shaft means mounted in said housing at approximately a right angle to said first shaft means and including one end extending out of said housing and provided with means to receive the end of a string to be mounted thereon; a worm-gear rotatably mounted within said housing in surrounding co-axial relationship to said second shaft means normally in engaged alignment with said worm on said first shaft means; means provided on the opposing end of said second shaft means relative to the end to which the string is attached to facilitate direct manual rotation of said second shaft means in at least one direction; said first shaft means being mounted in said housing for slideable longitudinal displacement between operative engagement and disengagement of said worm with said worm-gear; and spring means biasing said first shaft means and said worm toward operative engagement with said worm-gear whereby direct manual rotation of said second shaft means and said worm-gear in one direction displaces said first shaft means against the bias of said spring means to move said worm away from normal operative engagement with said worm-gear.

2. In a tuning device for musical string instruments, the combination of a housing means; a first shaft means rotatably mounted in a said housing and provided with a worm, one end of said first shaft means extending out of said housing and carrying a fixed handle-like key to facilitate manual rotation of said first shaft means, second shaft means mounted in said housing at approximately a right angle to said first shaft means and including one end extending out of said housing and provided with means to receive the end of a string to be mounted thereon; a worm-gear rotatably mounted within said housing in surrounding co-axial relationship to said second shaft means normally in engaged alignment with said worm on said first shaft means; means provided on the opposing end of said second shaft relative to the end to which the string is attached to facilitate direct manual rotation of said second shaft means in at least one direction; said second shaft means being slideably mounted for longitudinal displacement between a releasably connected position with said worm-gear and a disconnected position relative to said worm-gear, in said disconnected position said second shaft means being free to rotate independent of the normal operative engagement and the turning ratio established between said worm and worm-gear.

3. The apparatus defined in Claim 2 wherein said releasable connection between said second shaft means and said worm-gear includes key means provided on an inwardly directed face of a knob-like extension of said second shaft means and keyways adapted to mate with said key means provided on a hub-like extension of said worm-gear, engagement between said key means and said keyways being dependent upon the axial position of said second shaft means.

4. In a tuning device for musical string instruments, the combination of a housing means; a first shaft means rotatably mounted in a said housing and provided with a worm, one end of said first shaft means extending out of said housing and carrying a fixed handle-like key to facilitate manual rotation of said first shaft means, second shaft means mounted in said housing at approximately a right angle to said first shaft means and including one end extending out of said housing and provided with means to receive the end of a string to be mounted thereon; a worm-gear rotatably mounted within said housing in surrounding co-axial relationship to said second shaft means normally in alignment with said worm on said first shaft means; means provided on the opposing end of said second shaft relative to the end to which the string is attached to facilitate direct manual rotation of said second shaft means in at least one direction; and releasable connecting means between said second shaft means and said worm gear including ratchet serrations on an inner annular portion of a knob-like extension of said second shaft means which extends outwardly from said housing and a plurality of spring biased outwardly extending pawls provided on an intregal extension of said worm-gear which is disposed in engaged alignment with said ratchet serrations, whereby said knob-like extension and said second shaft means may be rotated in only one direction independent of the operative engagement and turning ratio established between said worm and worm-gear.

* * * * *